US006778140B1

(12) United States Patent
Yeh

(10) Patent No.: US 6,778,140 B1
(45) Date of Patent: Aug. 17, 2004

(54) ATCH HORN ANTENNA OF DUAL FREQUENCY

(75) Inventor: Ming-Hau Yeh, Hsinchu (TW)

(73) Assignee: D-Link Corporation, Hsinchu (TW)

( * ) Notice: Subject to any disclaimer, the term of this patent is extended or adjusted under 35 U.S.C. 154(b) by 0 days.

(21) Appl. No.: 10/379,698

(22) Filed: Mar. 6, 2003

(51) Int. Cl.[7] ..... H01Q 1/38
(52) U.S. Cl. ..... 343/700 MS; 343/786
(58) Field of Search ..... 343/700 MS, 772, 343/786, 702, 850

(56) References Cited

U.S. PATENT DOCUMENTS 5,825,333 A * 10/1998 Kudoh et al. ..... 343/781 R
6,323,818 B1 * 11/2001 Koh et al. ..... 343/786
6,492,946 B2 * 12/2002 Nagumo et al. ..... 343/700 MS

* cited by examiner

*Primary Examiner*—Hoang V. Nguyen
(74) *Attorney, Agent, or Firm*—Bacon & Thomas PLLC

(57) ABSTRACT

The present invention is to provide a patch horn antenna of dual frequency formed on a printed circuit board of a wireless electronic product, in which the horn antenna is formed on one side of the print circuit board, a first patch line is formed on the other side of the printed circuit board as a feed transmission line thereof by means of signal wave coupling, and a second patch line being extended from an opening of the horn antenna at one oblique side toward the other oblique side of the opening for effectively controlling the ranges of the frequency bands to obtain a good match between high and low frequency bands via adjusting the size of the second patch line the degree of the angle between two oblique sides of the opening or the coupling area of the first patch line.

9 Claims, 5 Drawing Sheets

ATCH HORN ANTENNA OF DUAL FREQUENCY

FIELD OF THE INVENTION

The present invention relates to horn antennas and more particularly to an improved patch horn antenna operable in two different frequency bands.

BACKGROUND OF THE INVENTION

There has been a significant growth in WLAN (wireless local area network) due to an increasing demand of mobile communication products in recent years. IEEE 802.11 WLAN protocol is the most important one among a variety of WLAN standards. The IEEE 802.11 WLAN protocol was established in 1997. The IEEE 802.11 WLAN protocol not only provides many novel functions for WLAN based communication but also proposes a solution for communicating between mobile communication products made by different manufacturers. There is no doubt that the use of the IEEE 802.11 WLAN protocol is a milestone in the development of WLAN. Further, the IEEE 802.11 WLAN protocol assures a single chip as an execution core, reduces a wireless communication cost, and enables WLAN to be widely used in various mobile communication products.

In the 1997 version of the IEEE 802.11 WLAN protocol, rules about physical layer and MAC (Media Access Control) layer are stipulated. As such, mobile communication products made by different manufacturers can not only communicate at the same physical layer but also have a consistent LLC (Logical Link Control). That is, layers under the MAC layer are transparent to network applications. The IEEE 802.11 WLAN protocol was further modified for being adapted to serve as a standard of both IEEE/ANSI and ISO/IEC in August 2000. The modifications comprise an embedded MIB (Management Information Base) of SNMP (Simple Network Management Protocol) for replacing an original MIB of embedded OSI, and two new protocols as follows:

(1) IEEE 802.11a WLAN protocol: It expands the standard physical layer, stipulates an operating frequency band of 5 GHz of the physical layer, uses an orthogonal frequency division technique for modulating data, and stipulates a data transfer rate between 6 Mbps and 54 Mbps in order to meet requirements of both indoor and outdoor wireless communication applications.

(2) IEEE 802.11b WLAN protocol: It is another expansion of the IEEE 802.11 WLAN protocol. It stipulates an operating frequency band of 2.4 GHz of the physical layer, uses CKK (compensation keyboard control) as a modulation technique in which the CKK is derived from a direct serial frequency expansion technique, and uses a multiple speed MAC for ensuring an automatic slowdown of data transfer rate from 11 Mbps to 5.5 Mbps when a distance between two adjacent workstations is too long or interference is severe. Alternatively, the above data transfer rate can be adjusted to 2 Mbps or 1 Mbps by employing the direct serial frequency expansion technique.

The operating frequencies of the standard physical layer are required to set at 5 GHz and 2.4 GHz based on IEEE 802.11a and IEEE 802.11*b* WLAN protocols respectively. Hence, several antennas are required to install in a wireless electronic product for complying with requirements of frequency band if the product is about to use the IEEE 802.11a and IEEE 802.11b WLAN protocols. However, such can increase a manufacturing cost, complicate an installation procedure, and consume precious space of the product for installing the antennas. As a result, the size of the product cannot be reduced, thereby contradicting the compactness trend.

Recently, there is a trend among wireless communication product designers and manufacturers to develop an antenna capable of operating in two different frequency bands (i.e., dual frequency antenna) in developing electronic products of dual frequency. It is envisaged that the use of dual frequency antenna in a wireless communication product can decrease the number of antennas provided therein and occupied space thereon. Unfortunately, commercially available dual frequency antennas such as chip antennas or patch antennas made by a printing process are not satisfactory in an operating frequency of 5 GHz. Some antennas can meet required features. However, they are bulky, resulting in an unnecessary consumption of space. Moreover, separately manufactured components are required for the well-known dual frequency antennas. Such components are then assembled in the well-known dual frequency antenna prior to together installing in the wireless communication product. Inevitably, it will increase manufacturing and assembly costs, thus contradicting both the cost reduction principle and the mass production trend.

A conventional antenna such as horn antenna 10 well known to wireless communication product designers and manufacturers is shown in FIG. 1. Signal waves are fed into the antenna 10 via a coaxial cable 11. The antenna 10 has advantages such as wide bandwidth, high antenna gain, and distinct polarization direction. Hence, the horn antennas 10 are widely used in experiments as a standard antenna for measuring radiation pattern or gain of a typical antenna. However, the horn antenna 10 is bulky and expensive. Hence, the conventional horn antennas are not suitable and even impossible to install in a typical wireless communication product.

An equivalent patch horn antenna 20 improved from the above horn antenna 10 by one of wireless communication product manufacturers is shown in FIG. 2. The patch horn antenna 20 is formed on a circuit board 9 during a printed circuit board manufacturing process. Characteristics of the patch horn antenna 20 is simulated by effecting various transmission line 21 feed designs in order to produce various patch horn antennas 20. The patch horn antenna 20 as some characteristics of the horn antenna 10. But the patch horn antenna 20 also has several characteristics different from that of the horn antenna 10 due to the use of a transmission line 21 or a matched structure 22. The patch horn antenna 20 is typically designed to operate in a single frequency. As a result, it cannot be incorporated in a wireless communication product of dual operating frequencies.

A widely used dual frequency antenna such as chip antenna 30 is shown in FIG. 3. As seen, a patch antenna 32 having a required shape is printed on a ceramic substrate 31. Next, the chip antenna 30 is formed on a circuit board 9. A patch line 33 of the antenna 30 is used as a feed transmission line for signal wave feed. Typically, the chip antenna 30 has a narrow effective bandwidth in a high frequency range. Thus, the chip antenna 30 cannot satisfy a bandwidth of operating frequency required by a wireless electronic product. Also, the chip antenna 30 is low in antenna gain. In addition to the above drawbacks, additional components are required for installing the chip antenna in the wireless electronic product, resulting in an increase of both manufacturing and assembly costs. Hence, it is not desirable to mount the chip antenna 30 in the wireless electronic product. Thus, the need for improvement still exists.

SUMMARY OF THE INVENTION

A primary object of the present invention is to provide a patch horn antenna of dual frequency formed on a printed circuit board of a wireless electronic product during a printed circuit board manufacturing process in which the horn antenna is formed on one side of the print circuit board for significantly reducing the manufacturing cost. Most importantly, the horn antenna can have sufficient bandwidths in two different frequency bands, resulting in an increase of system performance of the wireless electronic product. By utilizing this, the above drawbacks of the prior art chip antenna of dual frequency such as narrow bandwidth, low antenna gain, and high in both the manufacturing and assembly costs can be overcome.

One object of the present invention is to provide a patch horn antenna of dual frequency. A first patch line as a feed transmission line of the patch horn antenna is formed on the other side of the printed circuit board by means of signal wave coupling. The invention can control the ranges of two frequency bands by adjusting the length of the patch horn antenna. Alternatively, the invention can either control an antenna gain by adjusting a degree of the angle between two oblique sides of a horn opening or control a match between high and low frequency bands by adjusting a coupling area between an elongate recess and the first patch line. As an end, the produced patch horn antenna has advantages of simple structure, easy manufacturing, and reduced cost as well as can satisfy product specifications.

Another object of the present invention is to provide a second patch line at the opening of the horn antenna, the second patch line being extended from the mouth of an opening of the horn antenna at one oblique side toward the other oblique side of the opening. It is possible of effectively controlling the ranges of the frequency bands for obtaining a good match between high and low frequency bands by adjusting the size of the second patch line.

The above and other objects, features and advantages of the present invention will become apparent from the following detailed description taken with the accompanying drawings.

DETAILED DESCRIPTION OF THE PREFERRED EMBODIMENTS

Figure 1:
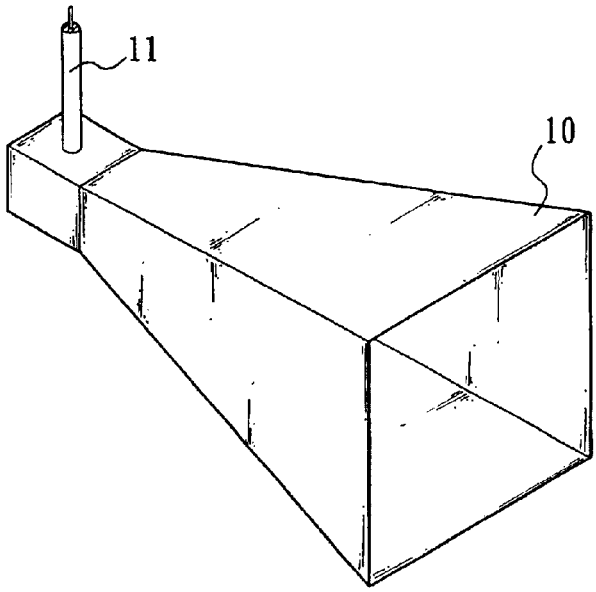
FIG. 1 (Prior Art)
FIG. 1 is a perspective view of a conventional horn antenna.
Figure 2:
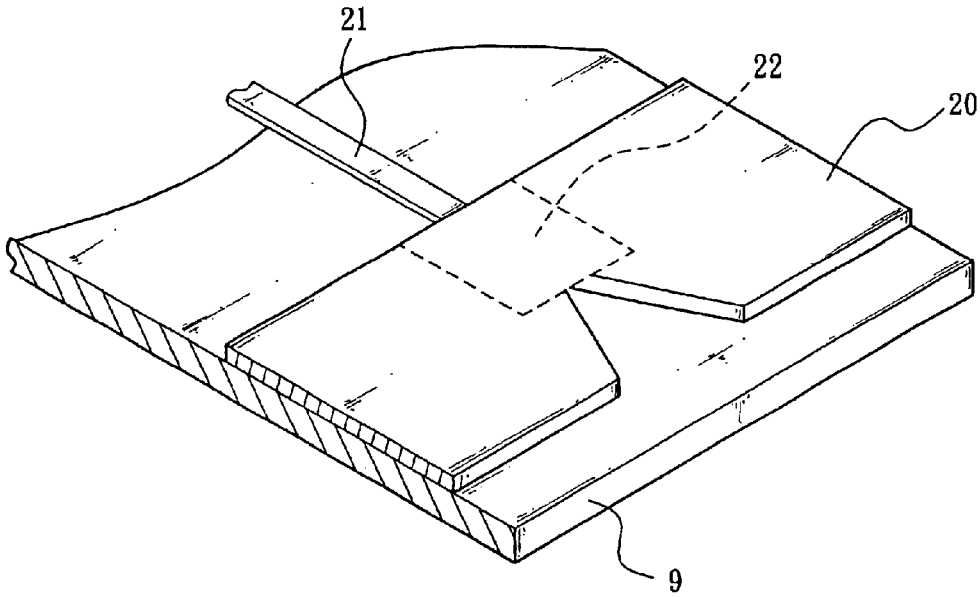
FIG. 2 (Prior Art)
FIG. 2 is a perspective view of a conventional patch horn antenna.
Figure 3:
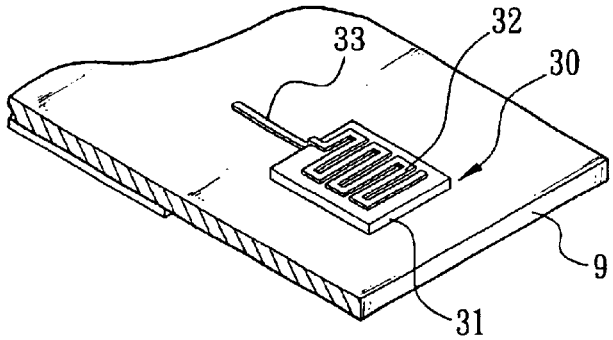
FIG. 3 (Prior Art)
FIG. 3 is a perspective view of a conventional chip antenna of dual frequency.
Figure 4:
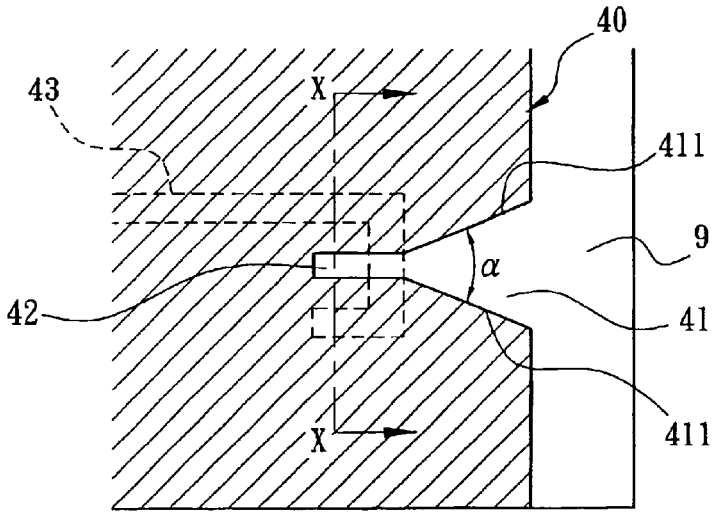
FIG. 4 is a top plan view of a patch horn antenna according to the invention.
Figure 5:
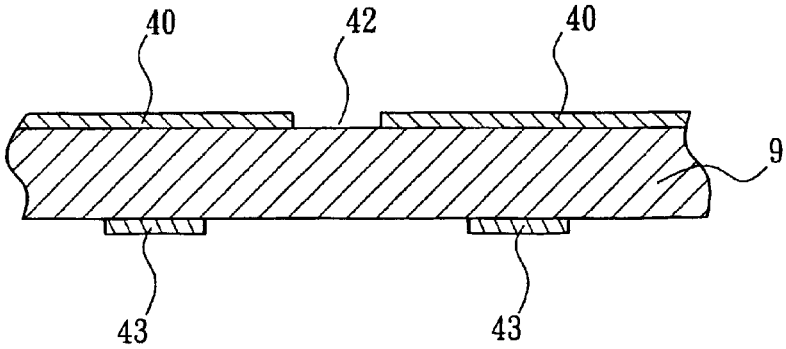
FIG. 5 is a cross-sectional view taken along line X—X of FIG. 4.
Figure 6:
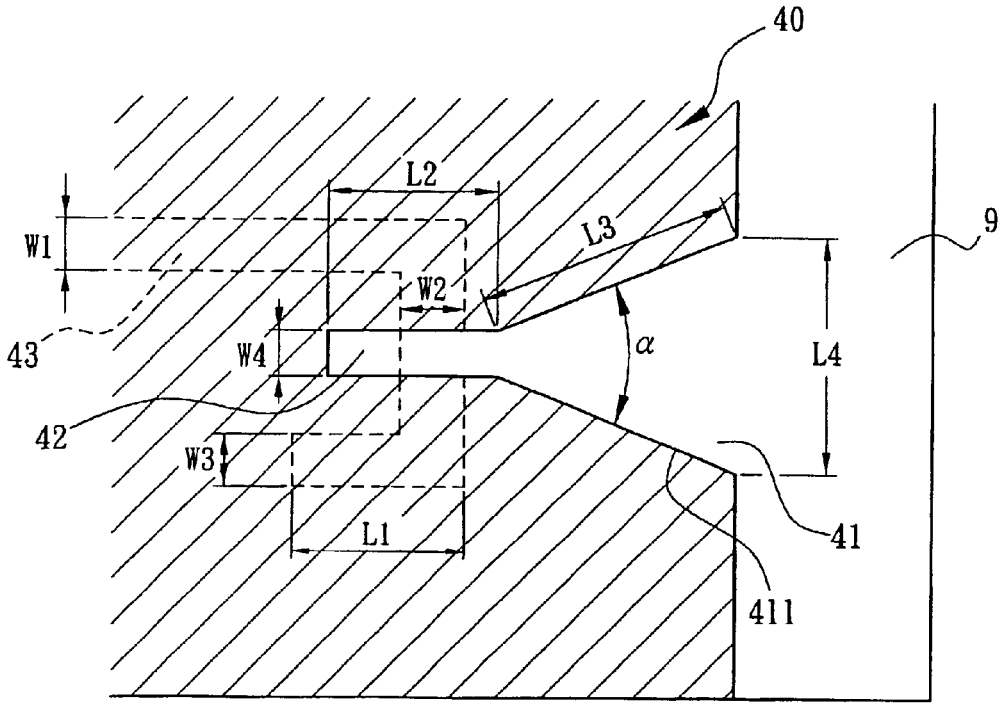
FIG. 6 is a top plan view of a first preferred embodiment of patch horn antenna according to the invention.

Referring to FIGS. 4, 5, and 6, there is shown a patch horn antenna 40 of dual frequency in accordance with the invention. The patch horn antenna 40 is formed on a printed circuit board 9 of a wireless electronic product during a printed circuit board manufacturing process in which the horn antenna 40 is formed on one side of the print circuit board 9. A horn opening 41 is formed at one side of the horn antenna 40. An angle a is formed between two oblique sides 411 of the opening 41. A length of each oblique side 411 is L3. An elongate recess 42 is extended inward from a corner of the angle $\alpha$a. A length of the recess 42 is L2. The recess 42 and the opening 41 form a horn of the invention having a length of L2+L3. A corresponding patch line 43 is formed on the other side of the recess 42. The patch line 43 is used as a feed transmission line of signal wave. The patch line 43 has one end coupled to a control circuit (not shown) printed on the other side of the print circuit board 9 and the other end extended substantially parallel with one side of the recess 42, turned 90 degrees to cross the recess 42, and turned 90 degrees again to extend a short distance substantially parallel with the other side of the recess 42, i.e., a substantially hook shape is formed at an open end of the patch line 43 as indicated by dash line in FIG. 4. As such, signal waves generated by the control circuit can be sent to the patch line 43 via the recess 42 in order to increase a performance of signal feed.

By utilizing the invention, it is possible of not only replacing the prior art technique of feeding signal waves by means of coaxial cable with the patch line 43 but also forming the horn antenna 40, the control circuit, and the patch line 43 on the print circuit board 9 directly in the manufacturing process of the print circuit board 9. Hence, the invention can significantly reduce the manufacturing cost by having a simple structure being easy to manufacture. Also, the produced horn antenna 40 can have sufficient bandwidths in two different frequency bands, resulting in an increase of system performance of the wireless electronic product. Moreover, the invention permits a modification of the horn antenna 40 in applications. For example, it is possible of controlling the ranges of two frequency bands by adjusting the length of the horn antenna 40. Alternatively, the invention can either control an antenna gain by adjusting a degree of the angle $\alpha$ or control a match between high and low frequency bands by adjusting a coupling area between the recess 42 and the patch line 43. As an end, the produced horn antenna 40 can satisfy product specifications.

Referring to FIG. 6, there is shown the first preferred embodiment of the invention. An input impedance of the patch line 43 of the horn antenna 40 is set as 50 ohms and a width of the patch line 43 is set as W1 respectively. The other end of the patch line 43 is extended parallel with one side of the recess 42, turned 90 degrees to cross the recess 42 in which the width of the patch line 43 is changed as W2, and turned 90 degrees again to extend a short distance substantially parallel with the other side of the recess 42 in which the width of the patch line 43 is changed again as W3. It is found that an optimum coupling is obtained when the widths W1, W2, and W3 of the patch line 43 satisfy the following two conditions:

(1) The width W2 is larger than the width W1 and less than three times of the width W1, i.e., $1*W1<W2<3*W1$.

(2) The width W3 is between the widths W1 and W2, i.e., $W1 \leqq W3 \leqq W2$.

As to a width W4 of the recess 42 in designing the horn antenna 40, the width W4 is preferably larger than the width W1 and less than two times of the width W1, i.e., $1*W1<W4<2*W1$. The length L2+L3 of the horn antenna 40 is preferably about one fourth (¼) of an equivalent wavelength of a resonant frequency at the low frequency band of the horn antenna 40. Also, a ratio between L2 and L3 is preferably larger than 0.7 and less than 1.3, i.e., $0.7<L2/L3<1.3$. The degree of the angle $\alpha$ is preferably larger than 10 degrees and less than 60 degrees, i.e., $10<\alpha<60$.

Based on the above design conditions of the horn antenna 40, the patch line 43 turns 90 degrees again to extend a short distance substantially parallel with the other side of the recess 42 in which the width of the patch line 43 is changed again as W3. Preferably, the length L1 is larger than 0.6 times of the length L2 and less than 1.4 times of the length L2, i.e., $0.6*L2<L1<1.4*L2$. As a result, an optimum signal feed performance is obtained when signal waves are fed into the horn antenna 40 via the patch line 43.

Figure 7:
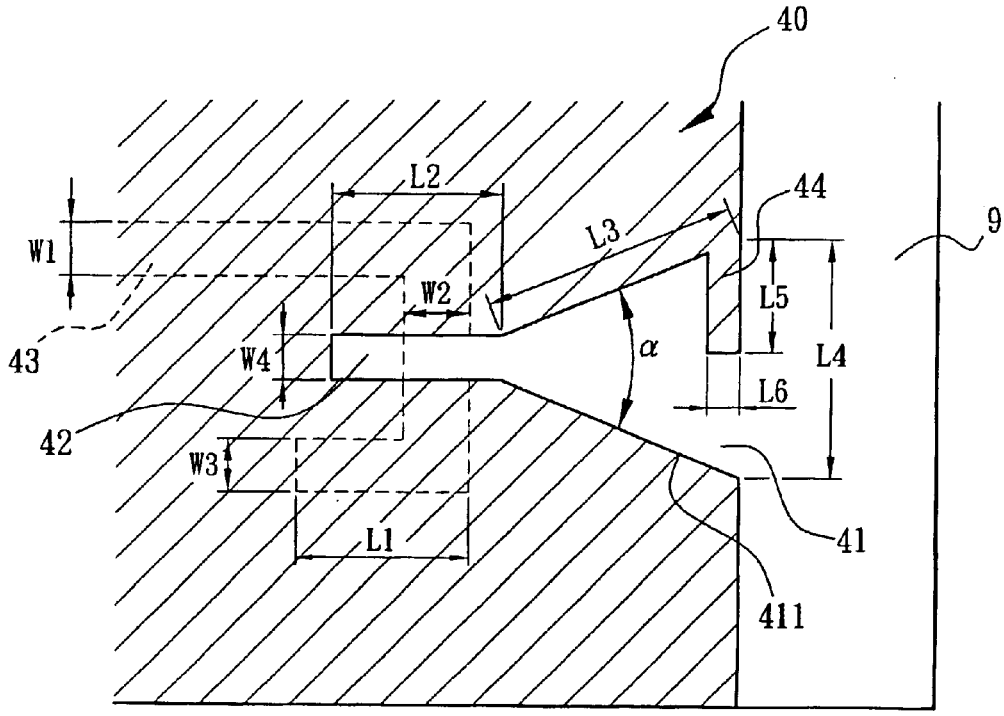
FIG. 7 is a top plan view of a second preferred embodiment of patch horn antenna according to the invention.

Referring to FIGS. 4 and 7, there is shown the second preferred embodiment of the invention. The difference between the first and the second preferred embodiments, i.e., the characteristics of the second preferred embodiment are detailed below. In the opening 41 of the horn antenna 40, a second patch line 44 is extended from the mouth of the opening 41 at one oblique side 411 toward the other oblique side 411. It is possible of controlling a match at the high frequency band of the horn antenna 40 by adjusting an extension (i.e., length L5 and width L6) of the second patch line 44 in order to obtain a good match. Preferably, the length L5 is smaller than 0.8 times of a length L4 of the opening 41, i.e., $0<L5/L4<0.8$.

Figure 8:
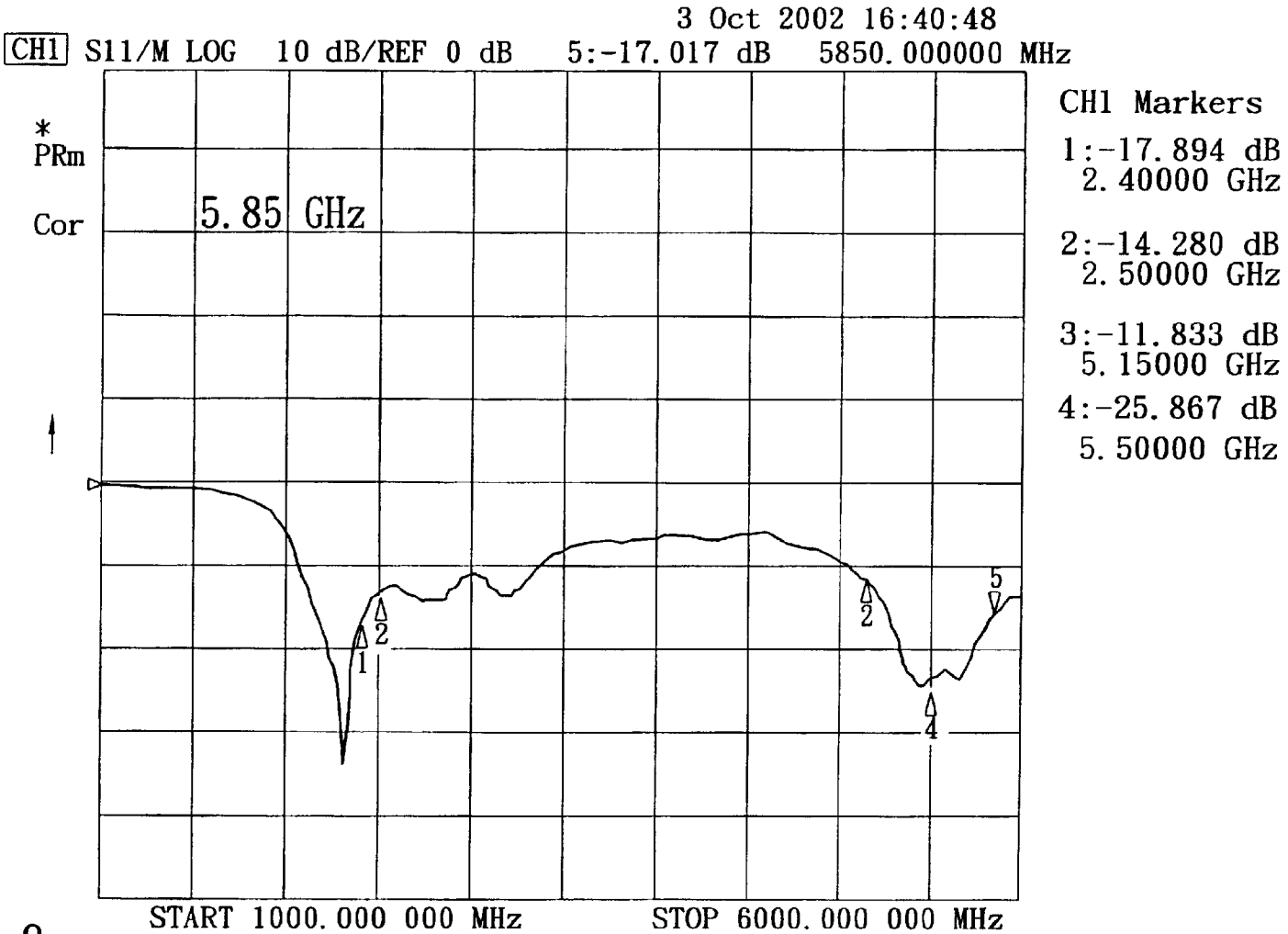
FIG. 8 is a graph showing test data obtained by the patch horn antenna of FIG. 6.
Figure 9:
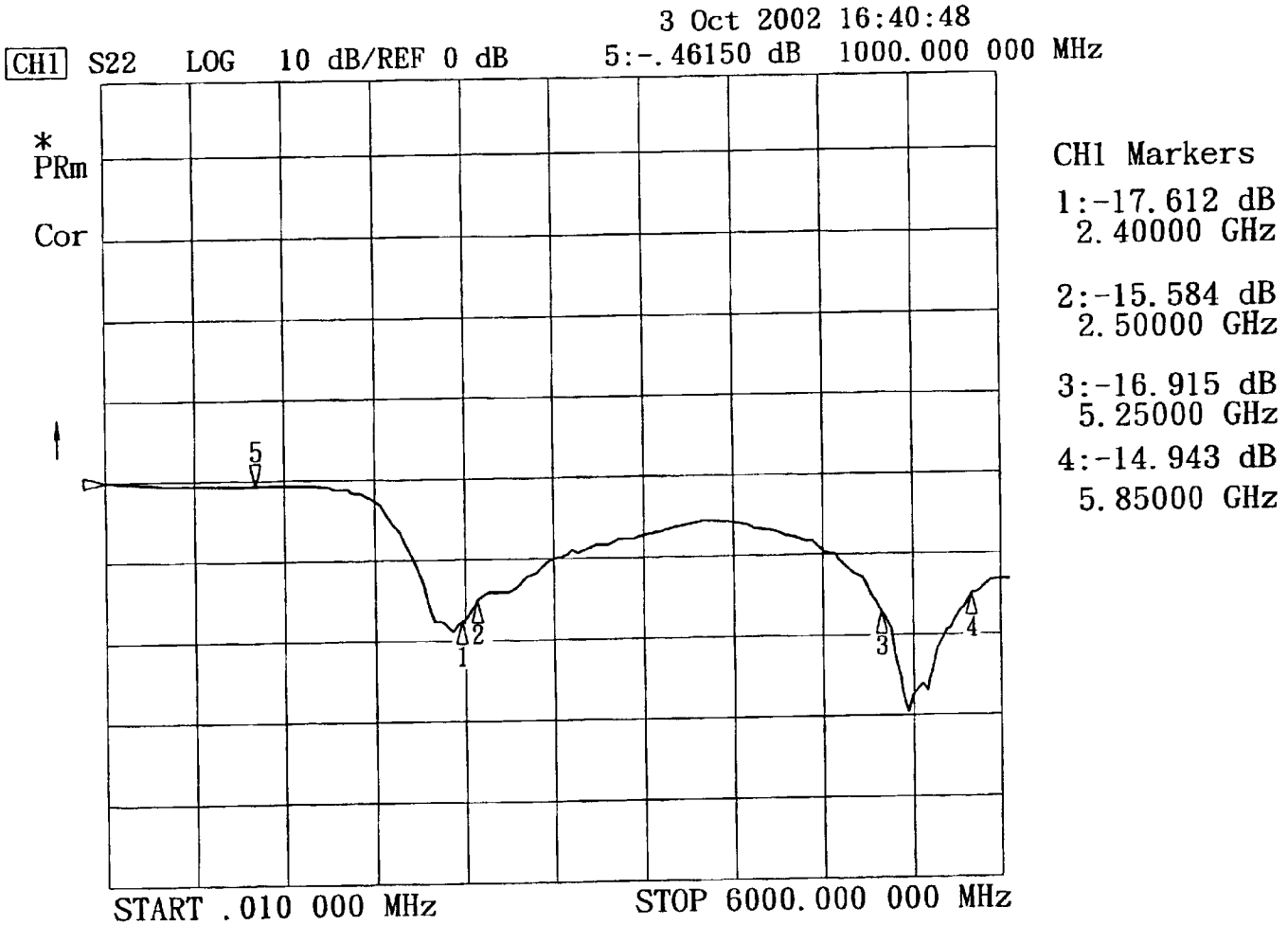
FIG. 9 is a graph showing test data obtained by the patch horn antenna of FIG. 7.

Two horn antennas 40 are formed on two different print circuit boards 9 based on the above design conditions of the preferred embodiments of the invention. Further, a frequency and impedance measurement device is used to test the horn antenna 40 of each of the first and second embodiments. Test results thus obtained are shown in FIGS. 8 and 9 respectively. In FIG. 8, the graph shows the test result when the second patch line 44 is not formed at the mouth of the opening 41 of the horn antenna 40. As seen, the horn antenna 40 has a good frequency response at frequency bands about 5.5 GHz and about 2.4 GHz. The invention can be implemented when two WLAN protocols are to be used by an electronic product. In detail, the horn antenna 40 is formed on one side of the print circuit board 9 and both the patch line 43 and the control circuit are formed on the other side of the print circuit board 9. As a result, a horn antenna 40 having sufficient bandwidths in two frequency bands and a simple structure is easily manufactured. Most importantly, the produced horn antenna 40 can increase system performance of the electronic product.

Referring to FIG. 9, there is shown a test result of the second embodiment obtained by using the same frequency and impedance measurement device to test the horn antenna 40 having the second patch line 44 formed at the mouth of the opening 41. As seen, the horn antenna 40 not only has a good frequency response at frequency bands about 5.85 GHz and about 2.4 GHz but also has a good match at the high frequency band due to the addition of the second patch line 44.

In brief, the invention can form the horn antenna 40 on one side of the printed circuit board 9 of an wireless electronic product during the printed circuit board manufacturing process for significantly reducing the manufacturing cost of antenna. Most importantly, the horn antenna can have sufficient bandwidths in two different frequency bands, resulting in an increase of system performance of the wireless electronic product. Moreover, the feed transmission line of the horn antenna 40 can be formed on the other side of the print circuit board 9 during the printed circuit board manufacturing process. As such, the conventional coaxial cable is eliminated. In addition, it is possible of effectively controlling the ranges of two frequency bands, antenna gain, and a match between high and low frequency bands by adjusting the length and the angle of the horn opening 41, the coupling area between the recess 42 and the patch line 43, and the size of the second patch line 44 in manufacturing the horn antenna 40. As an end, the produced horn antenna 40 has advantages of simple structure, easy manufacturing, and reduced cost as well as can satisfy product specifications.

While the invention has been described by means of specific embodiments, numerous modifications and variations could be made thereto by those skilled in the art without departing from the scope and spirit of the invention set forth in the claims.

What is claimed is:

1. A patch horn antenna device operable in two different frequency bands comprising:

a print circuit board including a control circuit of an wireless electronic product and a plurality of components for installation;

a horn antenna formed on one side of the print circuit board, the horn antenna including a horn opening formed at one side, the opening having an angle formed between two oblique sides thereof, and an elongate recess extended inward from a corner of the angle; and a first patch line formed on the other side of the print circuit board, the first patch line being served as a feed transmission line of signal wave, the first patch line having one end coupled to the control circuit printed on the other side of the print circuit board and the other end extended substantially parallel with one side of the recess, turned 90 degrees to cross the recess, and turned 90 degrees again to extend substantially parallel with the other side of the recess.

2. The patch horn antenna device of claim 1, further comprising a second patch line formed at the opening of the horn antenna, the second patch line being extended from a mouth of the opening at one oblique side toward the other oblique side.

3. The patch horn antenna device of claim 2, wherein a length of the second patch line is L5 which is smaller than 0.8 times of a length L4 of the opening, i.e., $0<L5/L4<0.8$.

4. The patch horn antenna device of claim 1, wherein an input impedance of each of the first and the second patch lines is set as 50 ohms.

5. The patch horn antenna device of claim 4, wherein a width of the first patch line is set as W1 which is changed as W2 when the other end of the first patch line is turned 90 degrees to cross the recess, the width of the first patch line is changed as W3 when the other end of the first patch line is turned 90 degrees again to extend substantially parallel with the other side of the recess, and an optimum coupling is obtained when the widths W1, W2, and W3 of the first patch line satisfy:

(a) the width W2 is larger than the width W1 and less than three times of the width W1, i.e., $1*W1<W2<3*W1$; and (b) the width W3 is between the widths W1 and W2, i.e., $W1 \leqq W3 \leqq W2$.

6. The patch horn antenna device of claim 5, wherein a width W4 of the recess is larger than the width W1 and less than two times of the width W1, i.e., $1*W1<W4<2*W1$.

7. The patch horn antenna device of claim 4, wherein a length of the recess is L2, a length of each of the oblique sides is L3, a length of the horn antenna is L2+L3 which is about one fourth of an equivalent wavelength of a resonant frequency at a low frequency band of the horn antenna.

8. The patch horn antenna device of claim 7, wherein a ratio between the lengths L2 and L3 is larger than 0.7 and less than 1.3, i.e., $0.7<L2/L3<1.3$.

9. The patch horn antenna device of claim 4, wherein a degree of the angle is larger than 10 degrees and less than 60 degrees, i.e., $10<\alpha<60$.

* * * * *